United States Patent [19]

Rasmussen

[11] 4,265,214

[45] May 5, 1981

[54] HEATER

[76] Inventor: Henry Rasmussen, P.O. Box 62, Kenora, Ontario, Canada, P9N 3X1

[21] Appl. No.: 893,806

[22] Filed: Apr. 5, 1978

[51] Int. Cl.[3] ..... F24C 1/14; F24B 5/00; F24H 3/00

[52] U.S. Cl. ..... 126/77; 126/15 R; 126/15 A; 126/76; 126/112

[58] Field of Search ..... 126/112, 15 R, 15 A, 126/76, 77

[56] References Cited

U.S. PATENT DOCUMENTS

| | | | |
|---|---|---|---|
| 646,863 | 4/1900 | Scott et al. | 126/77 |
| 665,436 | 1/1901 | Hever | 126/76 |
| 784,334 | 3/1905 | Landrus | 126/112 |
| 925,570 | 6/1909 | Eckert | 126/112 |
| 1,254,777 | 1/1918 | Colegrove | 126/112 |
| 1,476,201 | 12/1923 | Hoas | 431/263 |
| 1,627,735 | 5/1927 | Hadaway, Jr. | 126/15 A |
| 2,014,868 | 9/1935 | Steele et al. | 126/15 A |
| 2,143,994 | 1/1939 | McGlone | 126/15 A |
| 2,242,802 | 5/1941 | Stramaglia | 126/112 |
| 4,117,824 | 10/1978 | McIntire et al. | 126/15 R |

FOREIGN PATENT DOCUMENTS

| | | | |
|---|---|---|---|
| 1176944 | 1/1970 | United Kingdom | 126/76 |

*Primary Examiner*—Samuel Scott
*Assistant Examiner*—Wesley S. Ratliff, Jr.
*Attorney, Agent, or Firm*—Hill, Van Santen, Steadman, Chiara & Simpson

[57] ABSTRACT

A heating apparatus is disclosed wherein a combustion chamber which contains the fuel to be burned is located adjacent to an air heating chamber. Conduit means communicate from the air heating chamber to the combustion chamber for the purpose of leading air, which has been heated within the air heating chamber, into the combustion chamber. Blower means draw ambient air from the space surrounding the heater into the air heating chamber where it is blown through the conduit means into the combustion chamber to promote efficient combustion of the fuel.

3 Claims, 16 Drawing Figures

HEATER

This invention relates to apparatus for the efficient burning of fuels such as wood.

BACKGROUND OF THE INVENTION

Wood burning heaters, as well as those which burn coal, peat, animal manure, paper, etc. are probably about as old as mankind. In North America, for the past three decades or so, little interest has been shown in the burning of fuels, other than oil, for home heating. This lack of interest changed dramatically following the North American oil embargo of 1972-73 and the discovery that the supply of oil, whether in Canada or in the United States, is not unlimited but, in fact, is limited. Furthermore, over the past five years or so, since 1972, the price of fuel oil and oil-derived products such as gasoline has increased to the point where many persons are now actively considering the use of the well-known alternate energy sources namely, wood, coal, etc. There is also concern that such energy sources be efficiently utilized in well-designed heating units.

A specific problem which has beset some woodburning heaters in the past is the accretion of solid products of combustion in chimneys which educe smoke from stoves. Chimney fires are reasonably common and methods for avoiding the build up of combustible products in chimneys are required. It is well known that every winter a number of houses are destroyed and human lives lost because of fires originating in chimneys.

SUMMARY OF THE INVENTION

In accordance with the present invention, there is provided an apparatus for generating heat by the combustion of solid fuels which comprises:

(a) a combustion chamber in which fuel is to be burned, said combustion chamber having at least one heat conducting wall for transferring heat from said combustion chamber to the space surrounding the apparatus and at least one other heat conducting wall;

(b) an air heating chamber positioned adjacent said combustion chamber having at least one heat conducting wall located against said other heat conducting wall of said combustion chamber whereby heat may be conducted from said combustion chamber to said air heating chamber;

(c) blower means for drawing ambient air about the apparatus into said air heating chamber;

(d) conduit means communicating with said air heating chamber and said combustion chamber for leading heated air from said air heating chamber to said combustion chamber;

(e) a chimney outlet for evacuating gaseous products of combustion from said combustion chamber.

BRIEF DESCRIPTION OF THE DRAWINGS

In drawings which illustrate embodiments of the invention.

DETAILED DESCRIPTION WITH REFERENCE TO THE DRAWINGS

The heater, which is the subject of this invention, will be described by first considering the basic components thereof and their operation in broad outline form. Next, details of the construction of the heater are dealt with at length, explaining the reasons for their selection. Following this, the operation of the heater is studied with particular reference to the flow of air through the various chambers thereof. Lastly, other embodiments of this invention are briefly discussed.

Figure 1:
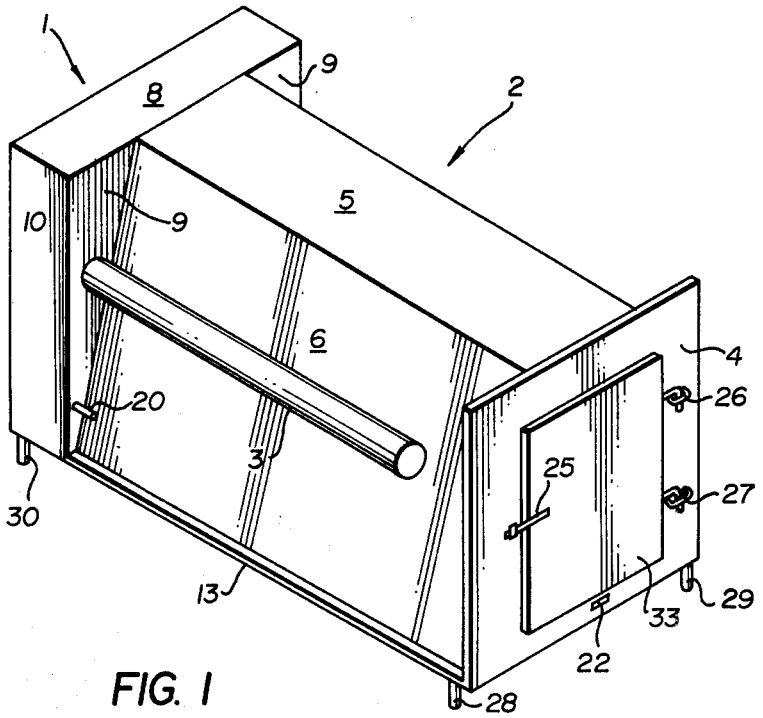
FIG. 1 is a perspective view of the heater showing the fuel-loading door in the foreground, the air heating chamber, combustion chamber and air tube leading from the air heating chamber to the combustion chamber.
Figure 2:
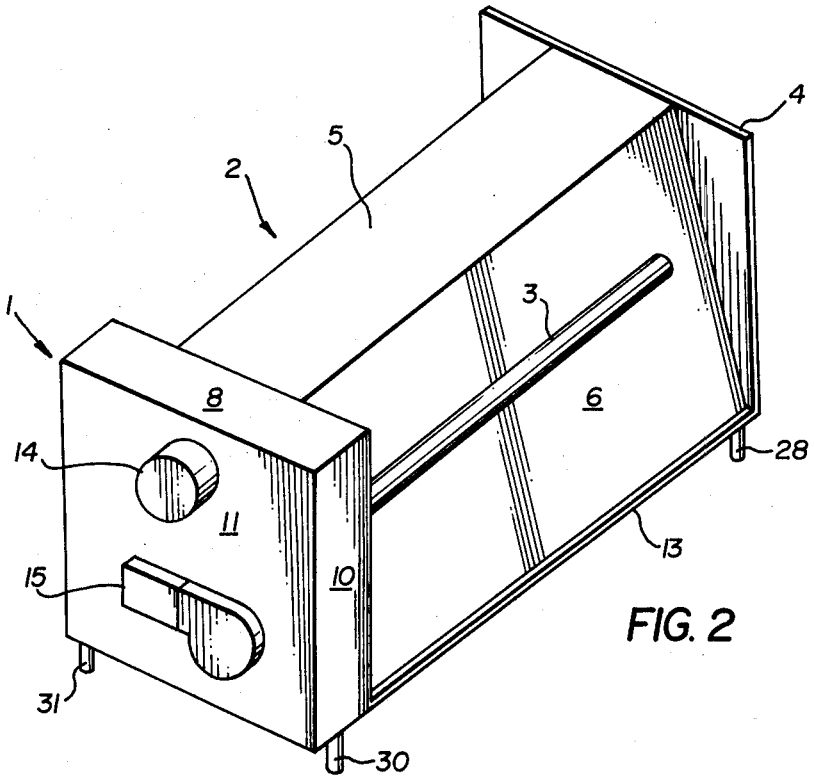
FIG. 2 is a second perspective view of the heater illustrating the chimney outlet and blower fan.

The fuel burning heater, illustrated in FIGS. 1-13 comprises an air-heating chamber 1 adjacent to a combustion chamber 2 as seen in FIGS. 1 and 2. As the name clearly implies, combustion or burning of fuel takes place in combustion chamber 2. The function of air-heating chamber 1 is to raise the temperature of the air blown through chamber 1 by means of a blower 15, to be discussed hereafter. Air thus heated is conducted from chamber 1 to chamber 2 by means of air tube 3. Outlets in air tube 3 cause the flow of heated air to be directed downwardly onto the fuel which is burning in chamber 2. It has been found that the flow of heated air downwardly onto burning fuel has a number of advantages which are later examined. Chambers 1 and 2 are formed from sheets of metal and air tube 3 is also of metal construction. The metal walls of chamber 2 are heated by the combustion of fuel therein. Therefore, tube 3 and the walls of chamber 1 are heated by the conduction of heat from chamber 2 through the metal walls thereof. The temperature of air which is forced through chamber 1 and tube 3 by means of blower 15 is thus increased by being passed over hot metal surfaces.

Figure 9:
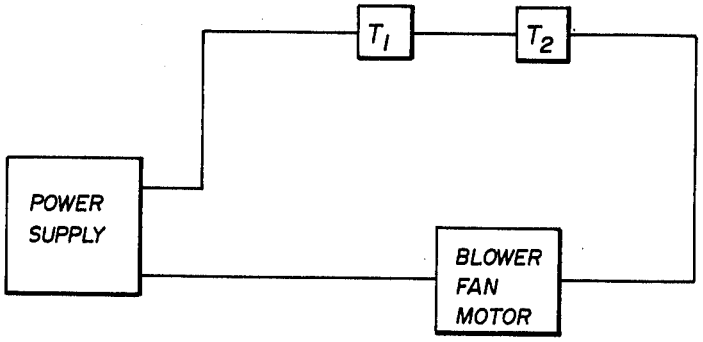
FIG. 9 is a schematic view of the thermostatic control system for the blower fan motor.

Blower 15 (seen in FIG. 2) is controlled by means of a thermostatic system illustrated schematically in FIG. 9. Thermostats $T_1$, $T_2$, the power supply and the motor which drives blower 15 are electrically connected in series. Thermostat $T_1$ is positioned in the air heating chamber 1 and thermostat $T_2$ is mounted on a nearby wall of a room or other space in which the heater is to be used.

Having briefly outlined an embodiment of the invention, a detailed examination of that embodiment now follows.

Figure 3:
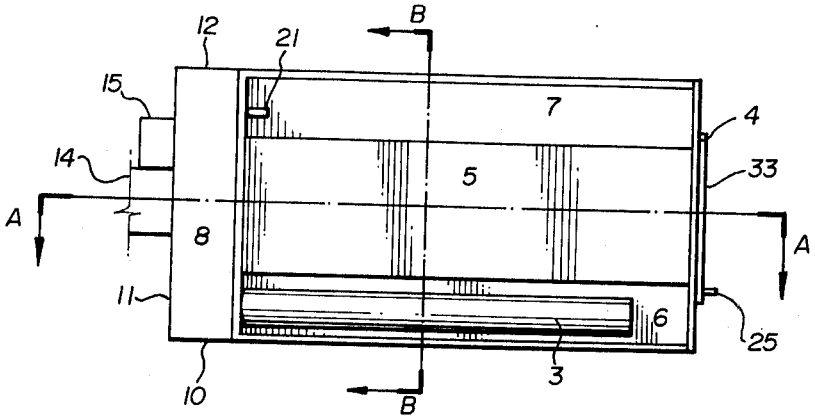
FIG. 3 is a top plan view of the heater.

Referring to FIGS. 1 and 2, which are perspective views of the heater from either end thereof, combustion chamber 2 comprises a bottom wall 13, sloping side wall 6, top wall 5 and vertical end walls 4 and 9. The counterpart sloping side wall 7 to side wall 6 is seen in FIG. 3, a top plan view of the stove. Thus, chamber 2 is enclosed by walls 13, 5, 6 and 7, and 4 and 9. The inventor has found that sloping walls 6 and 7, which slope outwardly and downwardly from top wall 5 greatly assist in the efficient transmission of heat from combustion chamber 2 to the region or room surrounding the heater and constitute an important feature of this invention. In one case, actually constructed by the inventor, the angle between wall 6 and bottom wall 13 was about 75°; the angle between walls 7 and 13 being the same.

The air-heating chamber 1 consists of end walls 9 and 11 (see FIGS. 1 and 2), bottom wall 13, side walls 10 and 12 and top wall 8, forming a rectangular parallelopiped. Chimney outlet 14 and blower 15 are mounted on end wall 11 as seen in FIG. 2. Bottom wall 13 and vertical end wall 9 are common to chambers 1 and 2.

In the embodiment of the invention depicted in FIGS. 1–13, which is the mode of the invention actually built by the inventor, the walls of chambers 1 and 2 each consisted of double thicknesses of 7 or 8 gauge steel plates, welded together at their edges.

Figure 4:
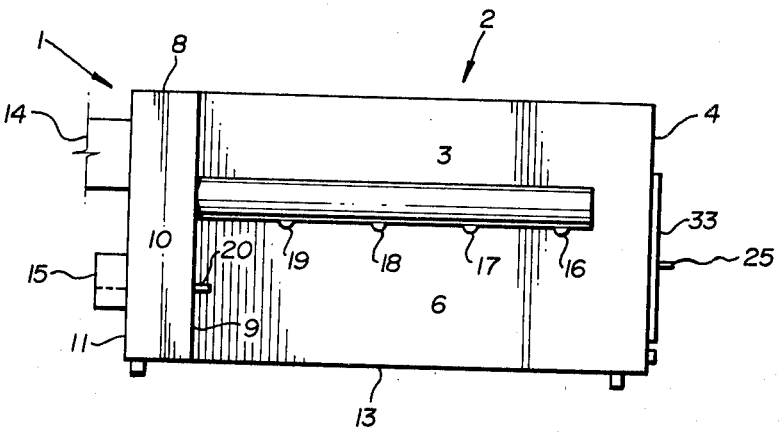
FIG. 4 is a side elevation view of the heater showing the air tube.

Air tube 3 is seen in perspective in FIGS. 1 and 2 and in the top view of the heater seen in FIG. 3. Referring to FIG. 4, a side elevation view of the stove, air tube 3 communicates with chamber 1 and is the means by which air heated in chamber 1 is conducted to chamber 2. Outlets 16, 17, 18 and 19 of air tube 3 cause air to be blown downwardly onto the burning fuel in chamber 2.

Figure 5:
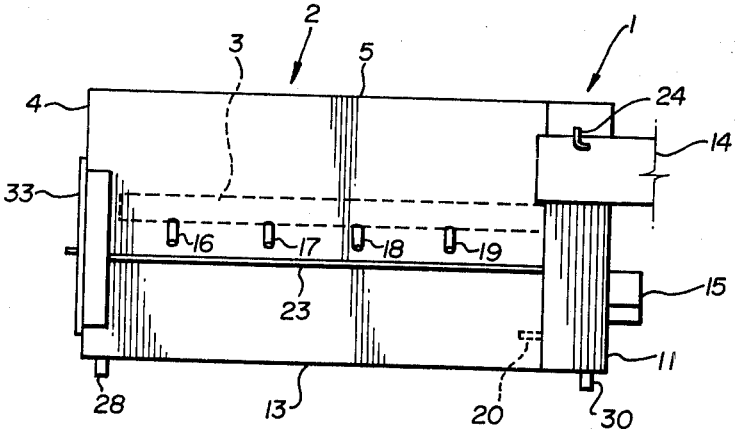
FIG. 5 is a cross-sectional view of the heater taken along line A—A of FIG. 3.
Figure 6:
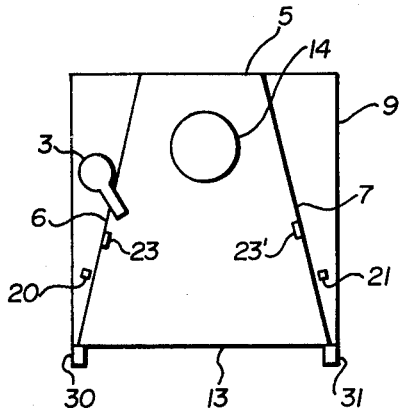
FIG. 6 is a cross-sectional view of the heater taken along line B—B of FIG. 3.

The operation of air tube 3 is best explained by FIGS. 5 and 6. FIG. 5 is a cross-sectional view of the stove along line A—A of FIG. 3 and FIG. 6 is a cross-sectional view of the stove taken along line B—B of FIG. 3. Tube 3 communicates with chamber 1 and runs along sloping side 6 of chamber 2. Downwardly directed outlets 16, 17, 18 and 19 of tube 3 cause air heated in chamber 1 and in tube 3 to be conducted through tube 3 and blown downwardly onto the fuel located in the bottom of combustion chamber 2.

Optional ribs 23 and 23', as depicted by FIGS. 5 and 6, may be placed along the interior side of sloping walls 6 and 7 of chamber 2 to provide additional structural support to the heater.

Chimney outlet 14 conducts gaseous products of combustion from combustion chamber 2 through air-heating chamber 1 and thence to a chimney or other means for leading the gaseous products away from the heater. Note that in this embodiment of the invention outlet 14 runs right through chamber 1 thus preventing the air blown through chamber 1 by means of blower 15 from being contaminated with smoke or other gaseous products of combustion. Outlet 14 also functions as a heat exchanger by which heat contained in the gaseous products of combustion is transferred to the cooler air drawn into chamber 1 by blower 15.

Another important feature of the stove is seen in FIG. 5, namely vent 24. By reason of blower 15 drawing air at room temperature into chamber 1 and thence along tube 3 and into chamber 2, the gas pressure inside chamber 1 exceeds the gas pressure inside chimney outlet 14. Thus, air will flow from chamber 1 through vent 24 into outlet 14. Air flowing into outlet 14 dilutes the concentration of the smoke therein and speeds its passage through whatever chimney or other evacuating means may be attached to outlet 14.

As a further option, two additional vents may be associated with chamber 1. These are tube vents 20 and 21 positioned near sloping walls 6 and 7 on outside wall 9 of chamber 1. Air flowing from chamber 1 and through vents 20 and 21 assists in carrying heat away from sloping walls 6 and 7 and into the air surrounding the heater. Vent 20 is most clearly depicted in FIG. 1.

In summary, air blown into chamber 1 from the surrounding base by means of blower 15 exits therefrom through air tube 3, and vents 20, 21 and 24.

Figure 7:
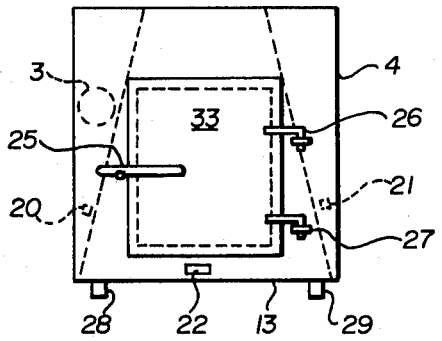
FIG. 7 is an end elevation view of the heater illustrating the fuel-loading door.
Figure 8:
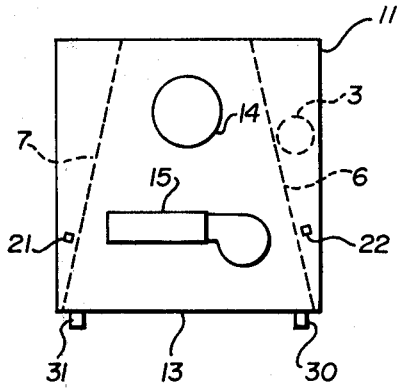
FIG. 8 is an elevation view of the other end of the heater from that seen in FIG. 7 depicting the chimney outlet and blower fan arrangement.

Some additional features of the stove are illustrated in FIGS. 7 and 8 which are end elevational views of wall 4 and wall 11, seen in FIGS. 1 and 2. With reference to FIG. 7, end wall4 has a door 33 supported by hinges 26 and 27, which door may be locked closed by means of latch 25. The purpose of door 33 is to allow for the insertion of wood or other fuel to be burned into the heater and the removal of solid products of combustion. Lighting vent 22 permits the ready visual inspection of the state of the fire burning in combustion chamber 2. Chimney outlet 14 and blower 15 are also seen in FIG. 8.

Lastly, the heater of FIGS. 7 and 8, may rest on feet or pedestals designated by numerals 28, 29, 30 and 31.

The rate of consumption of fuel in the heater is controlled by an electrical system depicted schematically in FIG. 9. The power supply, in the case of North America, will most likely be a 60 Hz., 110 volt supply of alternating current electricity, connected in series with thermostats $T_1$, $T_2$, and the motor which drives the fan of blower 15 of FIG. 2. Thermostat $T_1$, located inside air-heating chamber 1, has the property that it is an electrical short circuit if the temperature in chamber 1 exceeds some predetermined minimum (e.g. 70° F.). If the temperature about thermostat $T_1$ drops below the predetermined minimum, then thermostat $T_1$ acts as an open circuit and, hence, will not conduct electricity thereby turning off the fan motor. Thermostat $T_2$ may be positioned, for example, on the wall of a room to be heated by the heater. Thermostat $T_2$ is the more conventional thermostat which presents an open electrical circuit if the temperature of the air surrounding it exceeds a desired setting and, otherwise, is a short circuit. The result then is that the blower fan will operate for so long as the temperature inside chamber 1 exceeds some desired minimum and the temperature of the air about thermostat $T_2$ is less than the desired maximum temperature of the room in which the heater is located.

Therefore, if the fuel in chamber 2 is completely burned, the temperature of the air in chamber 1 will fall below the predetermined minimum setting of thermostat $T_1$ and the fan motor will be automatically turned off. Hence, the fan motor will not continue to operate if there is no fuel in combustion chamber 2. On the other hand, if there is burning fuel in chamber 2, the fan motor will continue to operate until the temperature of the room to be heated, as measured by thermostat $T_2$, attains the degree of warmth for which thermostat $T_2$ is set, at which time the operation of thermostat $T_2$ will turn off the fan motor.

Blower 15 is a commercially available device including an electric motor which drives an air blowing fan. (The fan draws air into chamber 1 where it is blown into air tube 3 and chamber 2). Of course, the rate of flow of heated air into chamber 2 should be so as to promote combustion of the fuel and not so great as to extinguish the fire.

This concludes the discussion of the structural features of the invention described herein. For greater clarity, the operation of the heater is now examined. Some aspects of the description of the operation of the stove may appear to be repetitive. Notwithstanding this, for the sake of thoroughness and transparent description of the invention, further comments regarding the functioning of the heater are justified.

It is expected that the usual type of fuel which will be burned in the heater will be wood. However, other solid fuels such as coal including cannel coal, rolled newspapers, packed rags, peat, corn stalks, and animal manure etc. could also be employed. If coal is the fuel selected, a grate should be placed on the bottom wall 13 of chamber 2. It is highly improbable that the stove would burn liquid fuel oil, primarily because it is not provided with the necessary nozzles and burner heads for the efficient combustion of oil.

Figure 10:
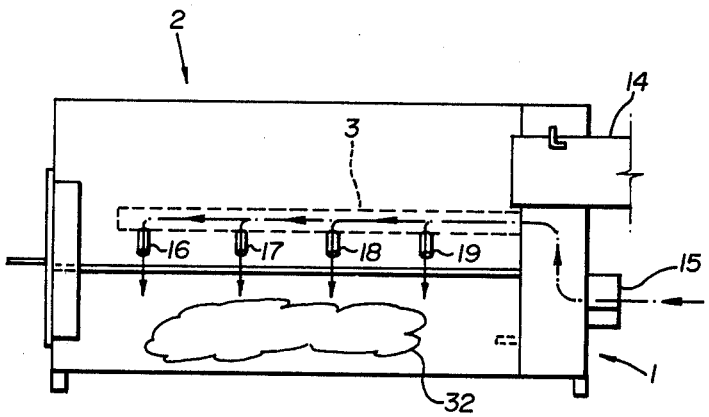
FIG. 10 is the same view as seen in FIG. 5 showing the expected direction of flow of air from the space surrounding the heater into the heating chamber, thence through the air tube and into the combustion chamber of the heater.

FIG. 10 is identical to FIG. 5, except that the direction of the flow of air through the heater and burning fuel 32 is indicated and some of the numerals of FIG. 5 have been removed. Air, at the temperature of that surrounding the heater is sucked into chamber 1 by blower 15 and blown through chamber 1 where it is heated by the metal walls of the chamber. (The walls of chamber 1 acquire heat energy by conduction from the walls of chamber 2, which chamber contains burning fuel). Air in chamber 1 is also heated by the passage therethrough of chimney outlet 14 which contains gaseous products of combustion. (i.e. smoke). Most of the air so warmed by chamber 1 is blown through air tube 3 and thence downwardly through outlets 16, 17, 18 and 19 onto burning fuel 32. The heated air, rich in oxygen, greatly assists in the clean and efficient burning of fuel 32. As previously discussed, blower 15 must be appropriately selected so that the rate of the flow of air from outlets 16, 17, 18 and 19 will promote the combustion of fuel 32 and, in particular, will not extinguish the fire. In the case of a wood fuel, a non-flaming, very hot, type of burning occurs. A further effect of the downward draught of heated air is to keep the heat generated by combustion of fuel near the bottom of the heater where it can be transferred into the surrounding room through sloping walls 6 and 7. (See FIG. 11). That is, for efficient operation of the heater, the heat of combustion should be dissipated through the walls of the stove and into the surrounding room or other space to be heated as opposed to being lost in the heating of gases produced by the burning of the fuel, which gases are carried away by a chimney. Furthermore, a more complete combustion of the fuel is obtained by the downward draft of heated air thereon. One of the results of better combustion is a diminished deposit of creosote (in the case of wood) or other solid deposits on the interior surface of chimney outlet 14 and the chimney leading from the heater. In addition, the heater may be employed to burn green or unseasoned wood when such wood is placed near the top of the pile of fuel in chamber 2. The green or unseasoned wood is not dropped to the bottom of chamber 2 and is therefore preheated and substantially dried prior to combustion.

Figure 11:
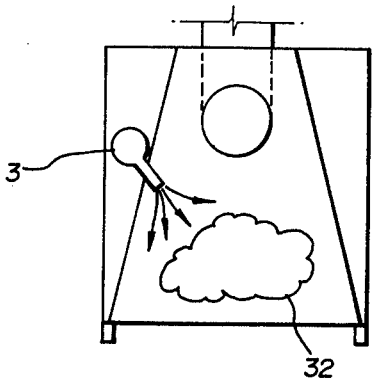
FIG. 11 is the same view of the heater as seen in FIG. 6, showing the likely direction of the flow of heated air from the air tube downwardly into the combustion chamber of the heater.

Referring to FIG. 11, which is identical to FIG. 6, except for the addition of air flow lines and deletion of some numerals, it is seen that air flowing from tube 3 passes through an outlet and thence downwardly onto the burning fuel 32.

Figure 12:
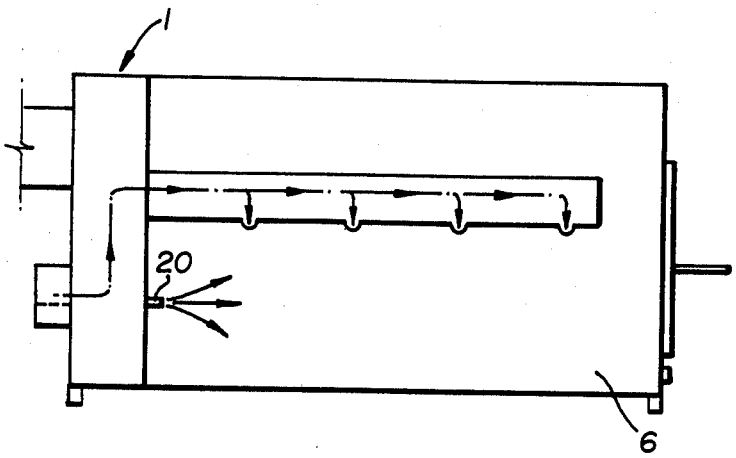
FIG. 12 is the same view of the heater as seen in FIG. 4 depicting the direction of flow of heated air through the air heating chamber, air tube and tube vents.

The operation of vents 20 and 21 is explained by FIG. 12, a figure which is identical to FIG. 4, save for the addition of air flow lines and deletion of some numerals. Air escaping from chamber 1 through vent 20 of FIG. 1 is blown across the surface of sloping sidewall 6 and assists in carrying away the heat of the stove to the adjoining room or other space to be warmed.

Figure 13:
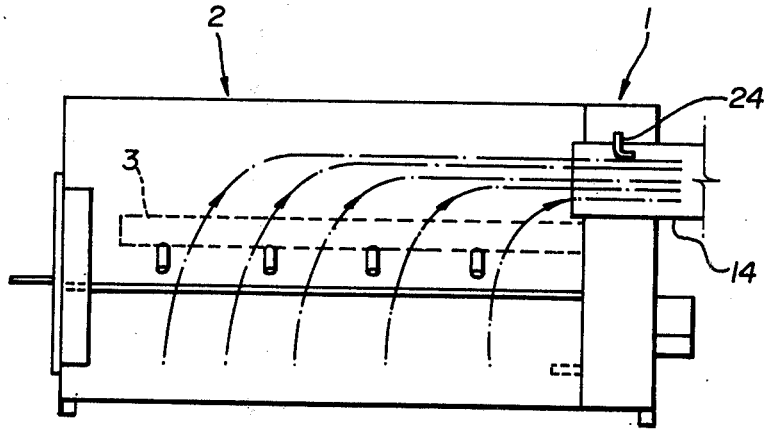
FIG. 13 is the same view as FIG. 5 and FIG. 10 illustrating the operation of the chimney vent and the expected upward flow of smoke therethrough.

Lastly, FIG. 13 is another version of FIG. 5 depicting the upward rise of smoke in combustion chamber 2 and its passage through chimney outlet 14. Vent 24 allows air to flow from chamber 1 into outlet 14 thereby increasing the rate of flow of smoke through the outlet. The combination of more complete burning of the fuel in chamber 2 and rapid evacuation of gaseous products of combustion ensures a minimized deposit of solids on the interior walls of chimney outlet 14 and the chimney, thereby reducing the likelihood of chimney fires.

It is of course, not necessary that chimney outlet 14 pass through chamber 1. As in the case of an ordinary heater or stove, outlet 14 could communicate directly from chamber 2 to the chimney or other means for removing gases from the heater. The inventor has built several versions of the heater wherein outlet 14 does not pass through chamber 1.

This concludes the discussion of one of the embodiments of the invention. It is to be understood that many modifications may be made without departure from the spirit of the invention.

Figure 14:
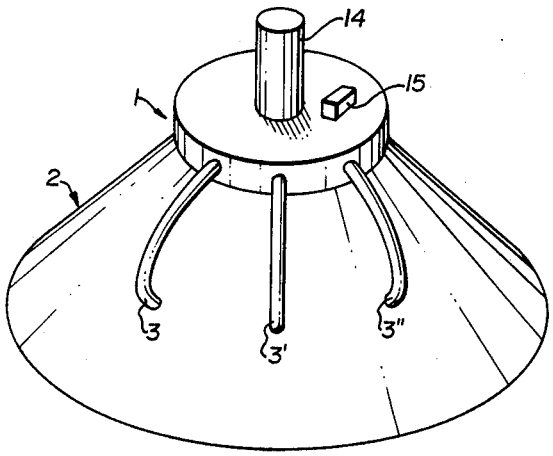
FIG. 14 is a perspective view of a second embodiment of the invention.

For example, FIG. 14 illustrates another embodiment of the invention in a perspective view. Air-heating chamber 1 is positioned above frusto-conical combustion chamber 2. Downwardly depending air tubes 3, 3', 3'', etc. conduct air blown into chamber 1 by means of blower 15 into chamber 2 and thence downwardly onto the fuel which is to be burned. Chimney outlet 14 extends from chamber 2 upwardly through chamber 1 to reduce gaseous products of combustion.

Figure 15:
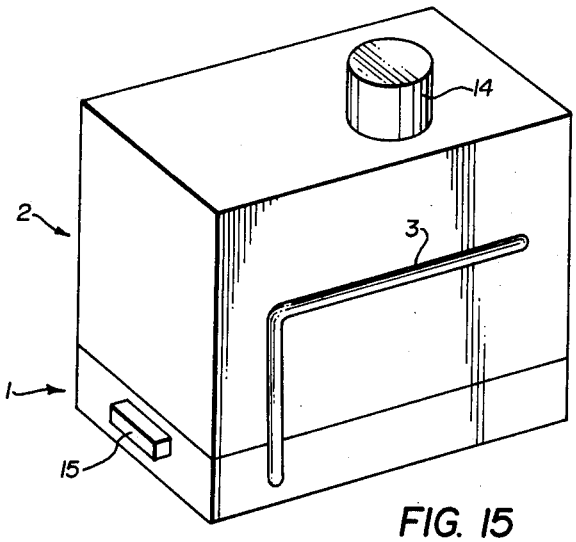
FIG. 15 is a perspective view of a third embodiment of the invention.

In FIG. 15, a third embodiment of the invention is shown in a perspective view. As before, ambient air is drawn into air heating chamber 1 by blower fan 15 and is thereafter conducted to chamber 2 by air tube 3 and thence is directed downwardly onto the fuel burning in combustion chamber 2. In the case of the embodiment of the invention depicted in FIG. 15, chimney outlet 14 does not pass through chamber 1.

Figure 16:
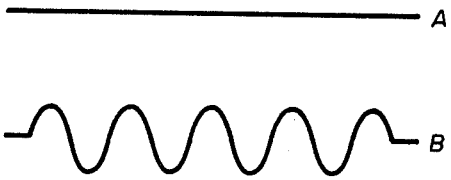
FIG. 16, in detail A, illustrates a schematic cross-sectional view of a flat outside wall of a heater and, in detail B, illustrates a second schematic cross-sectional view of a corrugated outside wall of a heater.

FIG. 16 is a schematic side view of a modification to one or more of the walls of combustion chamber 2. Chamber 2 performs two functions. First, it contains the fuel being consumed by combustion. Second, it operates as a heat exchanger whose purpose is to maximize the transfer of heat from the products of combustion to the space surrounding the stove. As is well known, the efficiency of a heat exchanger depends in part on the surface area available for the transfer of heat. Detail A of FIG. 16 shows a side view of a flat wall of chamber 2 separating the interior of the combustion chamber from the surrounding space. In detail B, a corrugated wall is illustrated in side view. Through the use of corrugations, the surface area for the exchange of heat from the heater is increased and the stove is rendered more efficient.

Lastly, it is to be noted that all parts of the heater need not be constructed from metal for so long as there is a heat conducting wall between chamber 1 and chamber 2, whereby the air within chamber 1 may be heated by virtue of the burning which takes place in combustion chamber 2. Of course, it goes without saying that suitable materials which will not themselves burn or melt when the heater is in operation must be employed in the construction of the heater; the suitable materials must also permit the outward flow of heat from chamber 2 to the surrounding region. Therefore, conducting materials such as metals are very likely to be selected. Also, the rate of the flow of heated air onto the fuel should not be so great as to extinguish the fire.

I claim:

1. An apparatus for generating heat by the combustion of solid fuels which comprises:

(a) a combustion chamber in which fuel is to be burned, said combustion chamber having two downwardly and outwardly sloping heat conducting walls for transferring heat from said combustion chamber to the space surrounding the apparatus and at least one other heat conducting wall;

(b) an air heating chamber positioned adjacent said combustion chamber having at least one heat conducting wall located against said other heat conducting wall of said combustion chamber whereby heat may be conducted from said combustion chamber to said air heating chamber;

(c) blower means for drawing ambient air about the apparatus into said air heating chamber;

(d) conduit means communicating with said air heating chamber and said combustion chamber for leading heated air from said air heating chamber to said combustion chamber, the flow of heated air being at a rate to promote the combustion of fuel to be burned in said combustion chamber;

(e) a chimney outlet for evacuating gaseous products of combustion from said combustion chamber, said chimney outlet passing through said air heating chamber;

(f) means for replenishing the supply of fuel to be burned and removing the products of combustion from said combustion chamber;

(g) temperature responsive control means for controlling said blower means and for causing said blower means to cease to operate if there is no fuel in said combustion chamber; and wherein (h) the portion of said chimney outlet located in said air heating chamber has a small vent therein communicating with said air heating chamber; and (i) said conduit means is a tube of heat conducting material communicating from said air heating chamber to said combustion chamber, that part of said tube within said combustion chamber having a plurality of downwardly directed outlets, said tube being so positioned that said outlets are placed above the region within said combustion chamber where combustion of fuel is to occur.

2. The apparatus of claim 1 wherein said one other heat conducting wall of said combustion chamber and said one heat conducting wall of said air heating chamber comprise a single wall common to said combustion chamber and said heating chamber.

3. The apparatus of claim 1 or 2 wherein said solid fuel is wood.

* * * * *